United States Patent [19]

Schmunk et al.

[11] 4,028,656

[45] June 7, 1977

[54] HIGH VOLTAGE FUSE WITH OUTER HEAT-SHRINKABLE SLEEVE

[75] Inventors: E. William Schmunk, Park Ridge; Thomas J. Tobin, Morton Grove, both of Ill.

[73] Assignee: S & C Electric Company, Chicago, Ill.

[22] Filed: Nov. 19, 1975

[21] Appl. No.: 633,487

[52] U.S. Cl. ..... 337/186; 337/202

[51] Int. Cl.[2] ..... H01H 85/20

[58] Field of Search ..... 337/186, 201, 202, 205, 337/158, 159, 279, 248; 174/DIG. 8

[56] References Cited

UNITED STATES PATENTS

| | | | |
|---|---|---|---|
| 3,291,939 | 12/1966 | Hitchcock | 337/279 |
| 3,648,211 | 3/1972 | McKeithan | 337/186 |
| 3,723,930 | 3/1973 | Koch | 337/158 |
| 3,798,583 | 3/1974 | Charbonneau et al. | 337/202 |
| 3,848,215 | 11/1974 | Kozacka et al. | 337/248 X |
| 3,913,051 | 10/1975 | Manker et al. | 337/186 X |

*Primary Examiner*—George Harris
*Attorney, Agent, or Firm*—Kirkland & Ellis

[57] ABSTRACT

A cylindrical sleeve having annular flanges is formed of irradiated terpolymers of ethylene, propylene, and a diene monomer (EPDM) material. The sleeve is then expanded, but the irradiated EPDM material has a "memory" which tends to cause it to return to its original dimension when heated to a predetermined elevated temperature. The expanded sleeve is positioned over the body of a current limiting fuse and heated so that the sleeve shrinks back to tend to assume its original dimension thereby sealing the sleeve around the body of the fuse. The inside surface of the sleeve may be coated with a thermosetting plastic sealing coating which softens at the elevated temperature further aiding in sealing between the fuse body and the sleeve. The sleeve may be heated in a vacuum oven to ensure that air is not trapped between the body of the fuse and the sleeve.

11 Claims, 2 Drawing Figures

HIGH VOLTAGE FUSE WITH OUTER HEAT-SHRINKABLE SLEEVE

BACKGROUND OF THE INVENTION

1. Field of the Invention

The present invention relates to improved high voltage fuses and methods of construction thereof.

2. Description of the Prior Art

High voltage fuses are well known in the art. Typically, high voltage fuses comprise a hollow cylindrical housing formed of a suitable electrically insulating material. Over the ends of the housing are mounted metallic end walls. A fusible element is positioned within the hollow insulated housing and connected at each end to the metallic end walls.

Because of the advances in technology, it is now possible to design and fabricate a current limiting fuse having a relatively short terminal to terminal length. While such fuses maintain adequate internal dielectric strength after operation, the external leakage path is not always adequate to prevent flashover between the terminals under wet or contaminated conditions because of the reduced length. Thus, it has been found to be desirable to include an increased insulating distance on the exterior of (or, elongate the external path over) the fuse to increase the leakage path and prevent external flashover.

However, it has been found that it is not always desirable to integrally form annular flanges on the cylindrical housing of the fuse. Thus, it would be a desirable advance in the art to provide improved methods of construction of high voltage fuses which permit the construction of a high voltage fuse having flange-like members or skirts that are not integrally formed with the insulated housing of the fuse.

BRIEF DESCRIPTION OF THE INVENTION

In accordance with the present invention, an improved method of construction of a high voltage apparatus including a hollow cylindrical housing having a first diameter comprises the steps (1) forming a hollow cylindrical sleeve having a second diameter slightly less than the first diameter of the housing from a material having a dimensional memory (such as irradiated terpolymers of ethylene, propylene, and a diene monomer, silicon rubber, or polyvinylchloride) having surface elongating means such as annular flanges formed on the exterior thereof for increasing the external leakage path of the apparatus; (2) expanding the hollow sleeve to a diameter greater than the first diameter of the fuse housing; (3) positioning the sleeve concentrically around the housing; and (4) heating the sleeve to a predetermined temperature to cause the sleeve to shrink until it adheres to the housing. An improved high voltage apparatus in accordance with the present invention comprises the improvement of a hollow cylindrical sleeve fabricated from a material having a dimensional memory (such as irradiated terpolymers of ethylene, propylene, and a diene monomer, silicon rubber, orpolyvinylchloride) having surface elongating means formed on the exterior thereof for increasing the leakage path of the apparatus. The sleeve is positioned over the hollow cylindrical housing and shrunk around the housing to form a moisture proof seal therebetween.

The irradiated terpolymers of ethylene, terpropylene, and a diene monomer, silicon rubber (cured silicon rubber elastomer), and polyvinylchloride have a 'memory' which tend to cause the sleeve to return to its original diameter when heated to the predetermined temperature. To further facilitate the sealing between the housing and the sleeve, the interior surface of the sleeve may be coated with a flexible thermosetting plastic sealing material before the sleeve is positioned over the housing so that when the sleeve is heated, the flexible theremosetting plastic sealing material will soften so that it will adhere to the surface of the housing. In addition, the sleeve may be heated in a vacuum oven to assure that air will not be trapped between the sleeve and the housing when the sleeve shrinks around the housing.

The flexible thermosetting plastic sealing material between the housing and the sleeve also acts as a seal between the housing and the sleeve so that air, moisture, and dirt are excluded from the interface between the housing and the sleeve and the interior of the housing. In addition, the sleeve is somewhat flexible and acts to protect the apparatus from handling shock.

Thus, it is a primary purpose of the present invention to provide an improved high voltage apparatus, such as a fuse, and method of construction thereof that allows annular flanges or skirts to be mounted on the exterior of the fuse without requiring them to be integrally formed to the fuse body.

Yet another object of the present invention is to provide an improved high voltage apparatus and method of construction thereof which provides a moisture proof seal around the apparatus housing.

Yet another object of the present invention is to provide an improved high voltage apparatus and method of construction thereof that prevents air pockets from being trapped between the apparatus housing and the sleeve.

Yet another object of the present invention is to provide an improved high voltage apparatus and method of construction thereof having a shock absorbing sleeve around the exterior thereof which acts to protect the apparatus from rough handling damage.

These and other objects, advantages, and features of the present invention will hereinafter appear, and for the purposes of illustration, but not for limitation, exemplary drawings of the present invention are provided.

DETAILED DESCRIPTION OF THE PREFERRED EMBODIMENT

Figure 1:
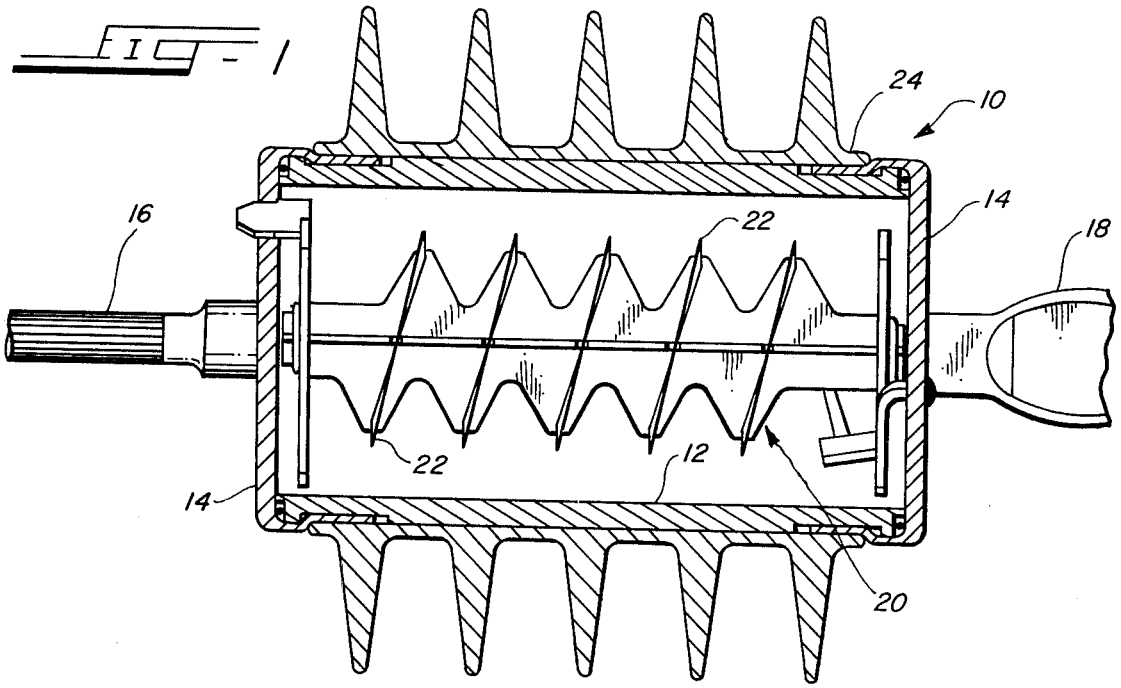
FIG. 1 is a slide cross-sectional view of a fuse constructed in accordance with the present invention.

With reference to FIG. 1, a completed fuse 10 comprises hollow cylindrical housing 12 formed of a suitable electrically insulating material such as plastic resin. Positioned over the end of cylindrical housing 12 are metallic end ferrule members 14 that are compressed over the end of housing 12. The manner in which end ferrule members 14 are compressed does not form a part of the subject matter of this invention and is described in more detail in co-pending application Ser. No. 633,486, Filed Nov. 19, 1975, assigned to the same assignee as the present invention. Mounted to the end ferrule member 14 are a mounting stud 16 and a mounting spade 18 which may be used to mount the fuse 10 in an electrical circuit.

Positioned within housing 12 is fusible element support assembly 20 which is mounted at each end to end ferrule member 14. Fusible element support assembly 20 supports a fusible element 22 that is electrically connected between the end ferrule member 14. Fusible element support assembly 20 does not form a part of the subject matter of the present invention and is more specifically described in co-pending application Ser. No. 633,486, filed Nov. 19, 1975, assigned to the same assignee as the present invention.

Figure 2:
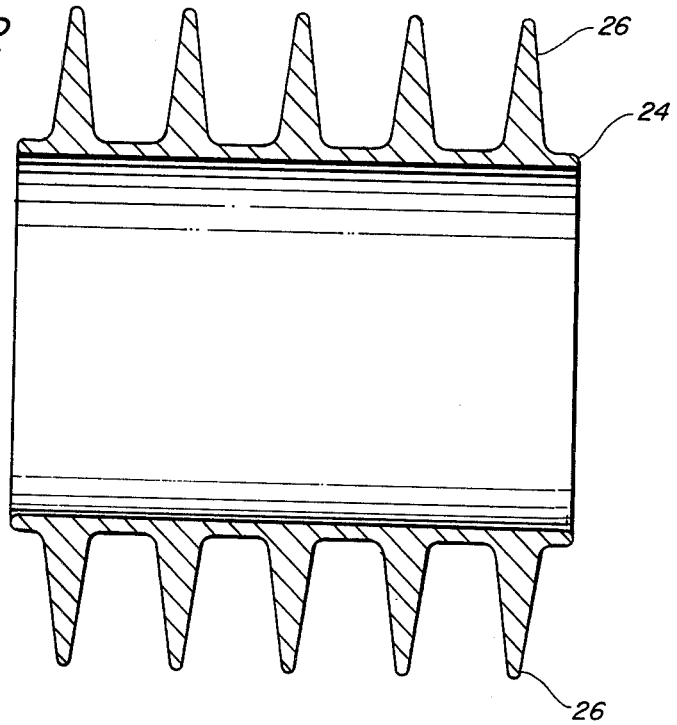
FIG. 2 is a cross-sectional view of the sleeve before it is mounted on the fuse body.

Positioned around housing 12 and sealing against the surface thereof is sleeve 24. With reference to FIG. 2, sleeve 24 is a hollow cylindrical sleeve having surface elongating means in the form of annular insulator flanges 26 formed around the exterior thereof. Flanges 26 act to increase the surface length of fuse 10 thereby increasing the external leakage distance of fuse 10. However, a variety of surface elongating means other than flanges, could be used to increase the external length of the fuse.

Sleeve 24 is preferably formed of irradiated terpolymers of ethylene, propylene, and a diene monomer, conveniently known as EPDM material. EPDM material is resistant to heat, aging, and provides improved dielectric strength and greater crush resistance. EPDM material has a good balance of physical and mechanical properties, retains its flexibility to temperatures as low as −65° F. and can be used in temperatures as high as 350°F. EPDM is virtually immune to ozone attack and is highly resistant to oxygen, sunlight, and water.

EPDM that is irradiated has cross-linked molecules which tend to give the EPDM a "memory" which causes the irradiated EPDM material to return to its original dimensions after deformation when it is subjected to a predetermined elevated temperature. Sleeve 24 is fabricated so that it has an internal diameter slightly less than the diameter of cylindrical housing 12. Sleeve 24 is Sleeve 24 expanded until its diameter is slightly greater than the diameter of housing 12 so that it can be positioned over housing 12 to the position illustrated in FIG. 1. The sleeve 24 is then heated to the predetermined temperature so that the "memory" of the EPDM material causes sleeve 24 to shrink to seek its original diameter so that it is firmly sealed against the exterior surface of housing 12 and the edges of end ferrule members 14. The heating operation may be performed in a vacuum oven so that air is effectively removed prior to the heating so that air will not be trapped between sleeve 24 and housing 12. In addition, the interior surface of sleeve 24 may be coated with a thermosetting plastic sealing coating 28 which becomes soft when heated so that when sleeve 24 shrinks around fuse 10, the thermosetting sealing coating 28 effects a water tight seal between the exterior surface of the housing 12 and the ends of end ferrule members 14. Thus, the thermosetting plastic sealing coating 28 provides a moisture proof seal to prevent the introduction of moisture into the interior of fuse 10. Alternatively, thermosetting plastic sealing coating 28 may be applied as a separate preformed cylinder or as a tape wrapped around housing 12 before sleeve 24 is shrunk in place.

Since EPDM material is relatively flexible and has substantial mechanical strength, sleeve 24 acts to provide additional strength to fuse 10 and to absorb the shocks incident to rough handling of fuse 10. In addition, sleeve 24 increases the ability of fuse 10 to withstand the mechanical forces due to internal pressure during fuse operation of fuse 10.

Alternatively, sleeve 24 may be formed of irradiated silicon rubber (cured silicon rubber elastomer) or polyvinylchloride which may be equally suitable depending upon the anticipated use and location of fuse 10.

Thus, it may be seen that an improved method of construction of high voltage fuses is provided by utilizing a sleeve formed of irradiated EPDM, silicon rubber or polyvinylchloride that is shrunk over a high voltage fuse to allow surface elongating means to be attached to increase the external dielectric strength of the fuse. Further, the present method of construction provides a means of increasing the strength of the fuse and the ability of the fuse to withstand shocks incurred during rough handling.

It should also be apparent that various modifications and changes may be made in the present invention without departing from the spirit and scope of the present invention as defined in the appended claims.

I claim:

1. In a high voltage current limiting fuse, the fuse including a relatively short hollow cylindrical housing fabricated from an electrically insulating material, end walls mounted over each end of the housing, a current responsive element positioned within the housing, and means for connecting the current responsive element to an external circuit, said housing being relatively short for the current limiting capabilities of the fuse; wherein the improvement comprises:

a hollow cylindrical sleeve fabricated from an insulating material having a dimensional memory and having surface elongating means formed on the exterior thereof for increasing the external path of the fuse, said sleeve having a coating of thermosetting plastic on the interior surface thereof and being expanded in its radial dimension, positioned around the hollow cylindrical housing and bonded to the housing by causing said sleeve to seek its original radial dimension to form a moisture proof seal therebetween.

2. An improvement, as claimed in claim 1, wherein said insulating material is irradiated terpolymers of ethylene, propylene, and a diene monomer.

3. A improvement, as claimed in claim 1, wherein said insulating material is irradiated silicon rubber.

4. An improvement, as claimed in claim 1, wherein said insulating material is polyvinylchloride.

5. An improvement, as claimed in claim 1, wherein said surface elongating means comprise at least one annular flange.

6. An improved high voltage fuse having increased external dielectric strength, increased resistance to handling shock, and increased sealing against the ingress of moisture, the fuse being of the type wherein an open-ended tubular non-conductive housing containing a fusible element and a support element therefor, has its ends closed by a pair of metallic end caps between which the fusible element is electrically connected; wherein the improvement comprises:

a heat-shrinkable flexible non-conductive sleeve heat-shrunk onto the housing to thereby effect a tight seal between the sleeve, end caps, and housing and increase the ability of the fuse to resist shock forces; and means on the sleeve for increasing the external leakage path of the fuse.

7. An improved high voltage fuse, as claimed in claim 6, wherein said sleeve is irradiated terpolymers of ethylene, propylene, and a diene monomer.

8. An improved high voltage fuse, as claimed in claim 6, wherein said means on said sleeve comprises at least one annular flange.

9. An improved high voltage fuse having increased external dielectric strength, increased resistance to handling shock, and increased sealing against the ingress of moisture, the fuse being of the type wherein an open-ended tubular nonconductive housing containing a fusible element and a support element therefor, has its ends closed by a pair of metallic end ferrules between which the fusible element is electically connected, the ferrules having flanges to engage the outer periphery of the housing ends, wherein the improvement comprises:

a heat-shrinkable flexible non-conductive sleeve heat shrunk onto the housing and onto the ferrule flanges so as to effect a tight seal between the sleeve, the ferrule flanges and the housing and increase the ability of the fuse to resist shock forces; and means on the sleeve for increasing the external leakage path of the fuse.

10. An improved high voltage fuse, as claimed in claim 9, wherein said sleeve is irradiated terpolymers of ethylene, propylene, and a diene monomer.

11. An improved high voltage fuse, as claimed in claim 9, wherein said means on said sleeve comprises at least one annular flange.

* * * * *

UNITED STATES PATENT OFFICE

CERTIFICATE OF CORRECTION

Patent No. 4,028,656 Dated June 7, 1977

Inventor(s) E. William Schmunk and Thomas J. Tobin

It is certified that error appears in the above-identified patent and that said Letters Patent are hereby corrected as shown below:

Column 1, line 61, "orpolyvinylchloride" should read

--or polyvinylchloride--.

Column 2, line 1, "'memory'" should read --"memory"--.

Column 3, line 40, delete "Sleeve 24" (second occurrence)

Column 4, line 46, "A" should read --An--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*